US007160177B2

(12) United States Patent
Herold et al.

(10) Patent No.: US 7,160,177 B2
(45) Date of Patent: Jan. 9, 2007

(54) METHOD AND DEVICE FOR THE HIGH-PRECISION MACHINING OF THE SURFACE OF AN OBJECT, ESPECIALLY FOR POLISHING AND LAPPING SEMICONDUCTOR SUBSTRATES

(75) Inventors: Volker Herold, Jena (DE); Christian-Toralf Weber, Magdeburg (DE); Juergen Weiser, Magedeburg (DE)

(73) Assignee: IGAM Ingenieurgesellschaft für angewandte Mechanik mbH, Barleben (DE)

( * ) Notice: Subject to any disclaimer, the term of this patent is extended or adjusted under 35 U.S.C. 154(b) by 0 days.

(21) Appl. No.: 10/543,869

(22) PCT Filed: Jan. 23, 2004

(86) PCT No.: PCT/DE2004/000104

§ 371 (c)(1),
(2), (4) Date: Sep. 19, 2005

(87) PCT Pub. No.: WO2004/067228

PCT Pub. Date: Aug. 12, 2004

(65) Prior Publication Data

US 2006/0135040 A1 Jun. 22, 2006

(30) Foreign Application Priority Data

Jan. 27, 2003 (DE) ..... 103 03 407

(51) Int. Cl.
*B24B 49/00* (2006.01)
*B24B 51/00* (2006.01)
*B24B 1/00* (2006.01)

(52) U.S. Cl. ..... 451/41; 451/5; 451/288; 451/380

(58) Field of Classification Search ..... 451/41, 451/11, 5, 6, 9, 10, 285, 289
See application file for complete search history.

(56) References Cited

U.S. PATENT DOCUMENTS

| | | | | |
|---|---|---|---|---|
| 4,923,302 | A | 5/1990 | Ealey et al. | |
| 4,934,803 | A | 6/1990 | Ealey | |
| 5,094,536 | A | 3/1992 | MacDonald et al. | |
| 5,635,083 | A | 6/1997 | Breivogel et al. | |
| 5,720,845 | A * | 2/1998 | Liu | 156/345.13 |
| 5,888,120 | A | 3/1999 | Doran | |
| 6,083,089 | A | 7/2000 | Breivogel et al. | |

(Continued)

FOREIGN PATENT DOCUMENTS

| | | |
|---|---|---|
| DE | 43 02 067 | 7/1993 |

(Continued)

*Primary Examiner*—Joseph J. Hail, III
*Assistant Examiner*—Robert Scruggs
(74) *Attorney, Agent, or Firm*—Collard & Roe, P.C.

(57) ABSTRACT

A device for high-precision machining of the surface of an object, such as for polishing and lapping semiconductor substrates, in which the object is held on an accommodation surface for its machining. The accommodation surface can be deformed by means of a actuators connected to the surface in a positive-lock and/or non-positive-lock manner. The actuators are provided between a base plate and an accommodation plate that are mechanically biased relative to one another. The accommodation plate is configured, on its inside, with concentric grooves forming rigid rings in the axial direction. The individual rings are connected by solid substance joints. Piezo-stacks configured as actuator-sensor elements, as well as springs, are disposed between the faces of the rings and the base plates and are offset relative to one another by 120°.

3 Claims, 4 Drawing Sheets

U.S. PATENT DOCUMENTS

| | | | | |
|---|---|---|---|---|
| 6,143,123 | A * | 11/2000 | Robinson et al. | 156/344 |
| 6,210,260 | B1 | 4/2001 | Tanaka et al. | |
| 6,325,696 | B1 * | 12/2001 | Boggs et al. | 451/5 |
| 6,579,151 | B1 * | 6/2003 | Tseng et al. | 451/11 |
| 6,765,337 | B1 * | 7/2004 | Heinz et al. | 310/328 |
| 2002/0052052 | A1 | 5/2002 | Robinson et al. | |
| 2003/0211811 | A1 * | 11/2003 | Berman et al. | 451/5 |

FOREIGN PATENT DOCUMENTS

| | | |
|---|---|---|
| DE | 693 22 491 | 8/1999 |
| EP | 0 607 441 | 7/1994 |
| EP | 0 904 895 | 3/1999 |

* cited by examiner

METHOD AND DEVICE FOR THE HIGH-PRECISION MACHINING OF THE SURFACE OF AN OBJECT, ESPECIALLY FOR POLISHING AND LAPPING SEMICONDUCTOR SUBSTRATES

The invention relates to a method and an apparatus for highly precisely machining the surface of an object, especially for polishing and lapping semiconductor surfaces or to structural components in general with planar surfaces or slightly curved surfaces. Typical applications are the processing of wafers, mask blanks as well as lenses, mirrors and other optical structural components.

Aside from the relative speed between a surface to be processed and the support of polishing and lapping agents, the operating pressure acting upon the surface is of special importance in the highly precise machining of surfaces. According to the Preston hypothesis, the localized separation level Δh for removal processes (e.g. lapping, polishing, chemo-mechanical polishing (CMP)) is the result of $$\Delta h = k \cdot p \int v(t) dt$$

where k=constant, v(t)=speed, p=local pressure and t=processing time. From this it will be apparent influencing the localized separation level Δh is possible only by a localized change in the pressure p, whereas the speeds as a condition of the process is predetermined by the movement (number of revolution), and do not permit of any localized influences.

It is generally known that tools for processing objects, for instance substrates, are deformed in order to bring about definitive structural shapes and/or processing conditions. A distinction is made between active and passive conforming to a shape.

German specification DE 693 22 491 T2 discloses passive conforming to shape by elastic basic body with convex and concave areas. The polishing agent support can macroscopically change its shape in dependence upon the surface of the workpiece so that the convex areas of the workpiece are selectively polished microscopically. In accordance with German specification DE 43 02 067 C2 conformation to a shape is brought about by a soft polishing cushion. In both cases, the process is strictly a passive one, without any deliberate effect upon the shape of the surface of the object to be processed.

U.S. Pat. Nos. 5,635,083 and 6,083,089 describe active pneumatic conformations to shape by pressure acting on the rear surface of a wafer. In this case, the wafer, rather than engaging the so-called chuck but is guided instead by a retaining ring. The disadvantage is that it is only possible to change the form of a certain invariant basic geometry in a scaled manner.

U.S. Pat. No. 6,210,260 B1 describes a chuck provided below its tool surface with a pressure chamber for pneumatically sucking or conforming a wafer to a polishing support (polishing pad). Depending upon the pressure exerted, the form of the surface of the chuck may be may be globally changed, either convexly or concavely, by a predetermined invariant basic geometry. Convex-concave changes of form or deliberately affecting localized zones, for instance the margin, are not possible.

The use of piezo-electrical elements for changing the contour of a surface in CMP tools have been described in U.S. Pat. No. 5,888,120 and EP 0,904,895. The use of piezo-electrical actuators per se has been known from U.S. Pat. Nos. 4,934,803 and 4,923,302 in connection with the adjustment of a reflector. U.S. Pat. No. 5,094,536 discloses an actively deformable wafer chuck for use in lithography. The shape of the surface can be changed locally by actuators with the required compression being provided by a vacuum chamber. An image processing system is used to measure the geometry. In this case it is the workpiece to be processed the shape of which is changed directly, rather than the workpiece support. Especially in thin-walled workpieces this leads to undesirable localized unevenness.

In U.S. Pat. No. 5,888,120 and EP 0.904,895 A2 disclose apparatus for measuring the thickness of a film. The measuring process is based upon a laser interferometer. In connection therewith, the undersurface of a waver is optically scanned through a window in the polishing tool. The evenness of the wafer is determined by measuring the removal rate in defined zones. Signals are generating for controlling the actuators which are setting the required geometry of the wafer. However, the disclosed apparatus permits measurements of the film thickness in the area of the window only, and the effect of the window on the process can hardly by avoided.

It is an object of the invention to process, at a high reproducible accuracy, the surface of objects by a universally usable apparatus as well as with as little effort as possible in a comparatively short time, process deviations, inhomogeneities of the material, etc., notwithstanding.

The object the surface of which is to be processes such as, for instance, a semiconductor substrate, is received by gluing, adhesion, suction or the like, in a sandwich-like structure between two plates which mechanically tensioned toward each other. Between the plates tensioned toward each other, one of which serves as a receiving plate for the mentioned support of the object, well-known actuator-sensor systems are arranged which, depending upon their design, are positively and/or frictionally connected with the receiving surface and can locally and/or globally change its shape.

In accordance with the invention, prior to commencement of the machining operation the distribution of pressure which is important to the machining operation is determined in the surface to be processed. For this purpose the apparatus and the mounted object to be processed are pressed against a specially adjusted very plane counter surface or, in the machine directly, against a polishing plate, polishing agent support, polishing pad or the like. This leads to the formation within the surface to be processes of a characteristic localized pressure tension the strength and distribution of which is dependent upon the surface geometry (of the object and of the counter surface).

Another possibility is to determine the pressure distribution during the processing operation, without interrupting it (e.g. by stopping and/or lifting). For this purpose, the device mounted in the processing position and subjected to normal pressure is briefly subjected to, or relieved from, an additional force acting in a direction normal to the processing surface. This process changes the localized pressure tension distribution within the processing surface, the degree of change (increased or decreased pressure) being again dependent upon the surface geometry of the object and the counter surface. The pressure generated by the application of pressure before the operating process as well as the change in pressure distribution in the surface to be processed caused by the additional force during the operating process are detected as forces by the actuator-sensors associated with the given surface zone and are fed to a evaluation unit for determining the mentioned pressure distribution.

On the basis of the calculated pressure distribution control variables are then generated for the actuator-sensor elements for a defined surface treatment of the object with a site-specific effect, for locally changing in the shape of the receiving surface of the sandwich-like structure. The local changes in the shape serve as control values or parameters for generating defined locally effective processing forces (pressings) on the surface of the object. Thus, the surface treatment is initiated directly with a preset pressure distribution specifically adjusted to the intended processing task and process conditions. The presetting of the localized changes in the shape or the receiving surface may be carried out once prior to the process operation or, for instance by a continuous control process, during the course of the operation. In this fashion not only may specific shaping or a very high precision in the realization thereof be aimed at in a simple manner, but immediately occurring process deviations, such as inhomogeneities in the material, temperature changes, etc., may also be taken into consideration without having to go through heretofore required additional controls and tests of the kind which significantly interrupt, delay and complicate the operation and render it more complex. In this manner errors and imprecisions are detected which result from deviations of dimensions or (for instance, thermal) deformations of the workpiece, of the receiving surface, or the lapping or polishing agent support and of the guidance of the machine (e.g. angular deviations), which allow individual corrections or adjustments for any workpiece in process.

In respect of the attainable accuracy of the process it is particularly important that the inventive determination of the distribution of pressure avoids the need for additional measuring elements. So, by using known pressure gaging films for determining the distribution of pressure (Tekscan Inc., USA; Fuji, Japan; Pressure Profile Systems, USA) their geometry errors alone (e.g. thickness deviations) result in changes in pressure distributions of the kind not occurring in the operational process itself. Accordingly, the integration of such measuring systems in conventional chucks is not possible or, in the event, very complex. Furthermore, such systems are relatively sensitive so that their use is possible under laboratory conditions only but not under manufacturing conditions.

It is also greatly advantageous that control measurements of the pressure distribution can be carried out and, if necessary, detected process deviations can be compensated by appropriately energizing the actuator-sensor elements not only at the beginning but also during the process operation, even without interrupting it. The simple approach of generating the force results in significant savings of time relative to partially very complex measurements of the surface geometry in which the sources of error referred to above are only partially taken into consideration.

The invention will be described in greater detail with reference to embodiments depicted in appended drawings, in which.

Figure 1:
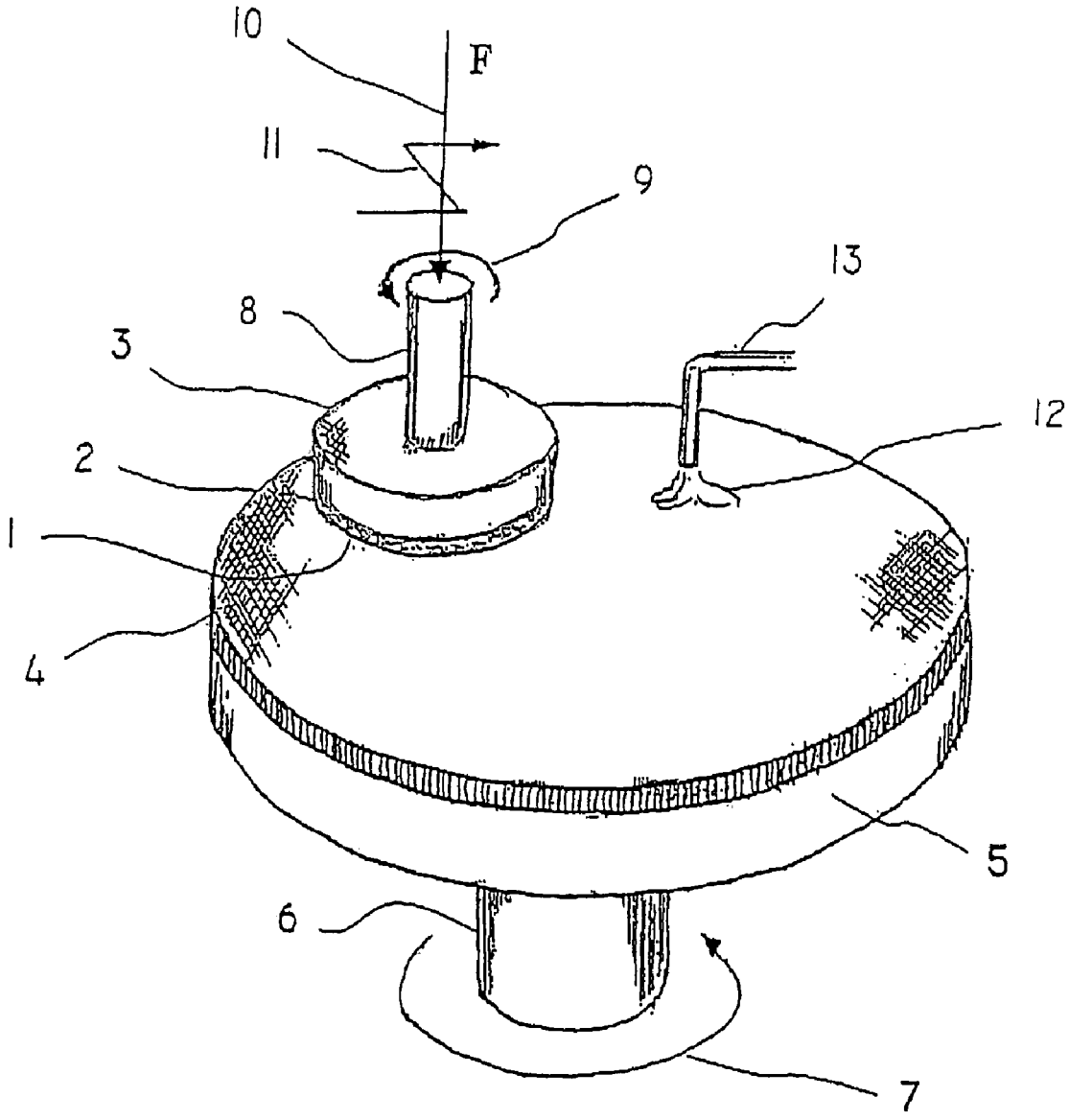
Fig. 1 PRIOR ART
FIG. 1 depicts a prior art apparatus for lapping or polishing the surface of a semiconductor substrate.

FIG. 1 is an exemplary presentation of the prior art relating to lapping or polishing a surface 1 of a semiconductor substrate 2. The semiconductor substrate 2 is attached to the undersurface of a receiver 3 by gluing, adhesion or suction. The surface 1 of the substrate 2 to be processed is placed upon the lapping or polishing agent support 4 (also known as a pad) which is attached to a lapping or polishing disc 5 rotating in a horizontal plane. The lapping and polishing disc 5 is set into rotary motion by a drive shaft 6 (symbolized by a curved arrow 7). The receiver 3 is set into rotary motion (indicated by curved arrow 9) as well by a further drive shaft 8, so that the semiconductor substrate 2 which is pressed against the lapping and polishing agent support 4 by a predetermined force F (see arrow 10) is rotating thereon at a speed relative thereto. In addition, the semiconductor substrate 2 may be oscillatingly moved radially over the lapping and polishing agent support 4 (see arrow 11). For the processing operation a lapping or polishing suspension 12 (slurry) is placed on the lapping and polishing agent support 4 by an appropriate dispensing device 13. For the chemo-mechanical polishing the lapping and polishing suspension 12 used contains active chemical components in addition to abrasive ingredients. In terms of the result of the processing operation, it is important that the active periods of the mechanical and chemical components of the lapping and polishing solution 12 are exactly tuned and conforming.

Figure 2:
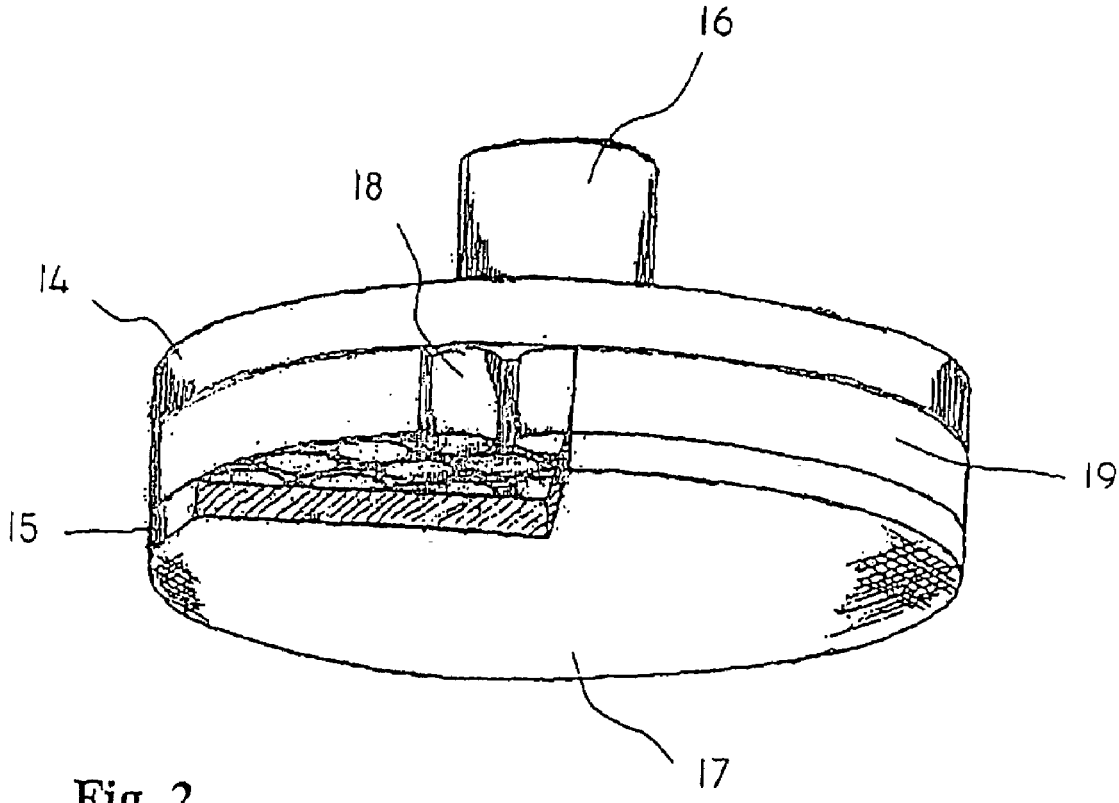
FIG. 2 shows a sandwich-like arrangement for receiving the object to be processed consisting of two plates with discrete actuator-sensor elements embedded in compensating material positioned therebetween.

FIG. 2 depicts a sandwich-like arrangement for receiving the object to be processed, consisting of a concentric base plate 14 with a concentric receiving plate 15. The base plate 14 is mounted on a shaft 16. The latter may be connected to a drive shaft (not shown for reasons of clarity). The receiving plate 15 and its receiving surface 17 serve to support the object to be processed (also not shown in FIG. 2). Between the base plate 14 and the receiving plate 15 there are disposed piezo plungers 18 as discrete actuator-sensor elements embedded in compensating material. The distribution of pressure of the receiving surface 17 is determined for processing the workpiece which is mounted on the receiving plate 15 by gluing, adhesion or suction, for instance.

For this purpose the workpiece is subjected to a force by placing it on the polishing plate, polishing agent support, pad or the like. This yields a characteristic localized distribution of pressure tension within the receiving plate 17 which by way of the receiving plate 15 act as forces on the piezo plungers 18 which are positively or frictionally arranged between the base plate 14 and the support plate 15. By their sensor function, the piezo plungers 18 detect the force acting upon them as a measure of the pressure distribution acting upon the receiving plate 17. For this purpose, the piezo plungers 18 are electrically connected to an evaluation and control stage (not shown).

The transmission of energy and data to an evaluation or control system mounted in the frame can take place either by conventional rotational connectors (slip rings) or wirelessly.

From the pressure distribution detected as described in the receiving plate 17 (and thus in the surface of the workpiece) control variables for the individual piezo plungers 18 are then determined by the mentioned evaluation and control unit for changing the shape in a locally specific manner of the receiving surface 17 of the receiving plate 15 (actuator function of the piezo elements). In this manner, the surface treatment is directly initiated with a preset pressure distribution specifically adjusted to the intended processing task as well as to the given processing conditions. In this manner, a high reproducible accuracy can be achieved in a processing operation, notwithstanding manufacturing tolerances, process deviations, inhomogeneities in material, etc.

The compensating material 19 into which the piezo plungers 18 are embedded is of lesser stiffness than the piezo plungers 18 and serves to bring about a flexible compensation between them. At the same time, the compensation material acts as an electrical insulator between the piezo plungers 18.

Figure 3:
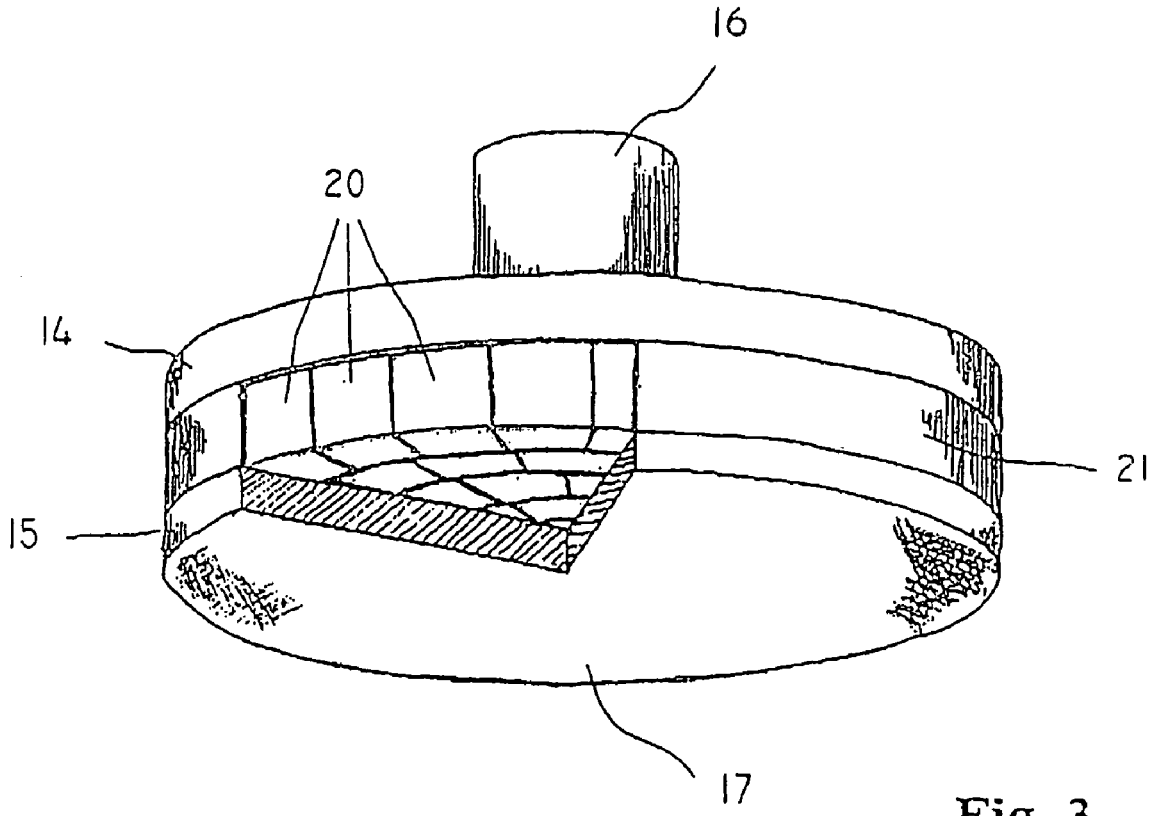
FIG. 3 shows a sandwich-like arrangement for receiving the object to be processed consisting of two plates and piezo-ceramics with segmented metalization layers positioned therebetween.

FIG. 3 depicts a sandwich-like structure comparable to the concentric base plate 14 and concentric receiving plate 15 of FIG. 2, except that the actuator-sensor elements in this case are not discrete piezo plungers but a segmented piezo ceramic material 20, the segments of which, in their sensor functions, may be individually read and, in their actuator function, individually energized. For insulation, and insulating layer 21 is provided around the piezo ceramic material 20 between the base plate 14 and the receiving plate 15. The function for adjusting the receiving surface 17 on the basis of the previously determined pressure distribution is basically identical to that described in connection with the embodiment of FIG. 2.

Figure 4:
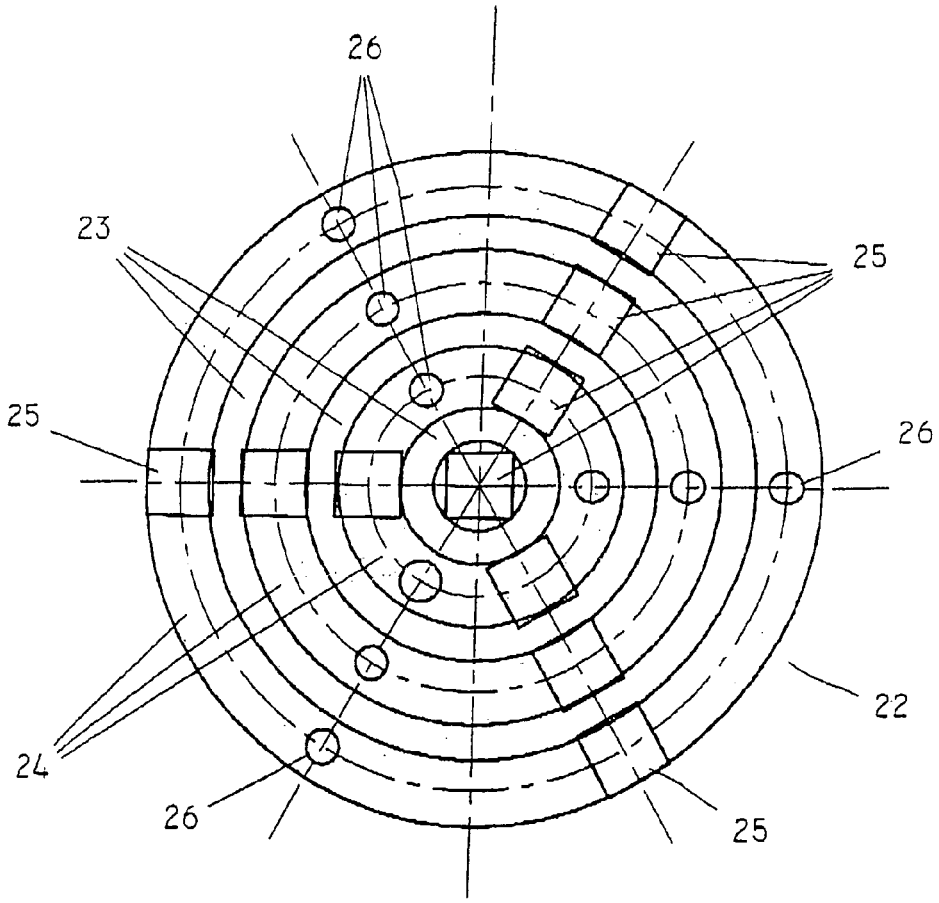
FIG. 4 represents two views of setting devices for the concentric changing of form of the receiving surface for the processing object.
Figure 4:
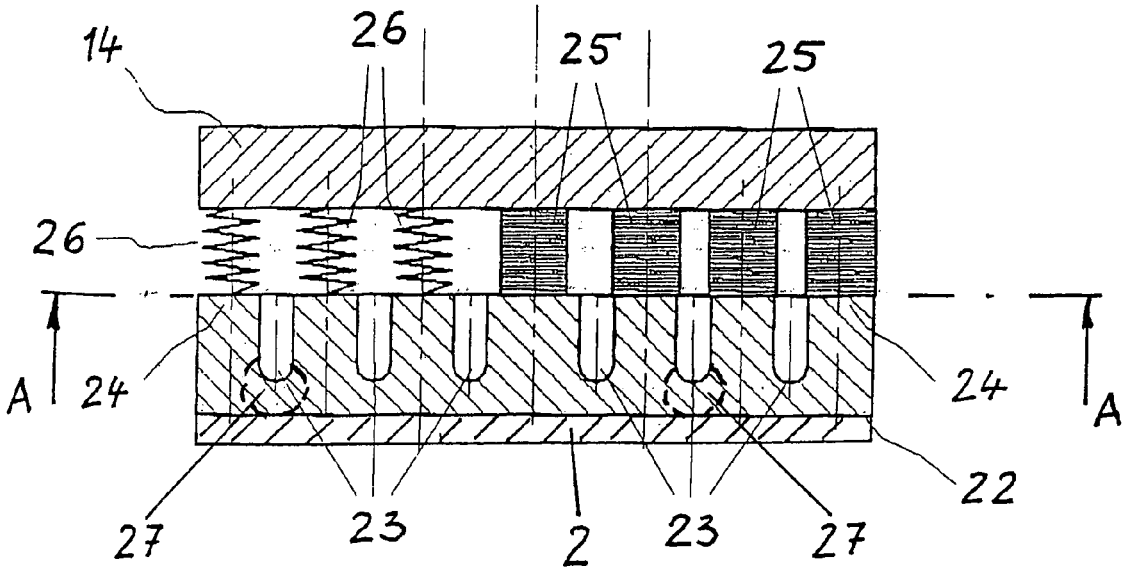

FIG. 4 depicts two views of a specific adjustment device for concentric changes of shape of the receiving surface upon which the workpiece is mounted. There is a sandwich-like structure of the concentric base plate 14 (again as a counter plate for the actuator-sensor elements) and a concentric receiving plate 22. A distinct from the receiving plate 15 in FIGS. 2 and 3, the surface of the receiving plate 22 is provided with concentric grooves 23. Localized weaknesses in the cross-section of the receiving plate 22 result in concentric solid material joints 27 which make it possible within the actuator zone of the said actuator-sensor elements to change the receiving plate 22 to practically any kind of concave, convex or concave/convex surface profile. Between the concentric grooves 23 axially very stiff rings 24 are formed in the interior surface of the receiving plate 22 which as actuator-sensor elements engage the piezo plungers 25 supported on the base plate 14. The base plate 14 and the receiving plate 15 are biased by springs 26. The piezo plungers 25 and the springs 26 form offset arrangements configured like treble-pointed stars forming lines displaced at 120° (see upper image of FIG. 4). Each one of these lines is formed by three piezo plungers 25 or springs 26 engaging the rings 24. In the center of this arrangement a further piezo plunger 25 may be provided 5. This arrangement provides for a statically defined system. However, the invention is not limited to either the described configuration nor to the shown number of piezo plungers 25 nor to the circumference and number of grooves 23, rings 24 and springs 26.

The base plate must be structured and dimensioned such that forces introduced by the support of the piezo plungers can lead to minimum deformations only. The rings 24 are to be a stiff as possible as it results in low undulation of the deformed receiving plate 22 even at a small number of piezo plungers 25 in the circumferential direction of the receiving plate 22. Determining the pressure distribution on the outer surface of the receiving plate 22 (and, hence, on the surface of the mounted workpiece) as well as the localized change in configuration fo the receiving surface 22 by the piezo plungers 25 are, again, basically identical to those described in connection with the embodiment of FIG. 2.

List of Reference Characters Used

1 surface to be processed
2 semiconductor substrate
3 receiver
4 lapping and polishing agent support
5 lapping and polishing disc
6, 8 drive shaft
7, 9 curved arrow
10, 11 arrow
12 lapping and polishing suspension
13 dispensing device
14 base plate
15, 22 receiving plate
16 shaft
17 receiving surface
18, 25 piezo plunger
19 compensating material
20 piezo ceramic material
21 insulating layer
23 grooves
24 rings
26 springs
27 solid material joint The invention claimed:

1. Device for high-precision machining of the surface of an object, particularly for polishing and lapping semiconductor substrates, in which the object is held on an accommodation surface for its machining, which surface can be deformed by means of a number of actuators that are connected with the former in positive-lock and/or non-positive-lock manner, and the actuators are provided between two plates that are mechanically biased relative to one another, the base plate and the accommodation plate, wherein the accommodation plate is configured, on its inside, with concentric grooves forming rigid rings in the axial direction, the individual rings are connected by way of solid substance joints, and piezo-stacks configured as actuator-sensor elements, as well as springs are disposed between the faces of the rings and the base plates, offset relative to one another by 120°, in each instance.

2. Device according to claim 1, wherein the piezo-stacks, starting in the center, are disposed in the shape of three stars between the faces of the rings and the base plate, and the springs are provided between the three piezo-stacks that run outward in star shape, in each instance.

3. Device according to claim 1, wherein the concentric grooves are configured with a concave, convex, or concave/convex surface profile.

* * * * *